US007538742B2

(12) United States Patent
Wang

(10) Patent No.: US 7,538,742 B2
(45) Date of Patent: May 26, 2009

(54) COLLAPSIBLE INTERIOR ANTENNA

(75) Inventor: Cheng-Si Wang, Changhua Hsien (TW)

(73) Assignee: Trans Electric Co., Ltd., Changhua Hsien (TW)

( * ) Notice: Subject to any disclaimer, the term of this patent is extended or adjusted under 35 U.S.C. 154(b) by 0 days.

(21) Appl. No.: 11/782,811

(22) Filed: Jul. 25, 2007

(65) Prior Publication Data

US 2009/0027284 A1 Jan. 29, 2009

(51) Int. Cl.
*H01Q 1/12* (2006.01)

(52) U.S. Cl. ..... 343/880; 343/803; 343/881

(58) Field of Classification Search ..... 343/880, 343/881, 882, 803, 805
See application file for complete search history.

(56) References Cited

U.S. PATENT DOCUMENTS 2,492,529 A * 12/1949 Kaplan ..... 343/805
2,495,748 A * 1/1950 Matson ..... 244/1 A
3,587,105 A * 6/1971 Neilson ..... 343/710
3,683,392 A * 8/1972 White et al. ..... 343/805
5,533,304 A * 7/1996 Noble ..... 52/40
6,204,824 B1 * 3/2001 Davi et al. ..... 343/803

* cited by examiner

*Primary Examiner*—Tho G Phan
(74) *Attorney, Agent, or Firm*—Rabin & Berdo, P.C.

(57) ABSTRACT

A collapsible interior antenna has a main antenna, two wing antenna assemblies and a secondary antenna. The main antenna is rectangular and has two opposite connecting edges. The wing antenna assemblies are pivotally mounted respectively on the connecting edges and connected transmittably to the main antenna. The secondary antenna is a telescopic antenna, receives signals having a different frequency band to the main antenna and is electrically mounted on the main antenna. A person can minimize a footprint of the collapsible interior antenna by retracting the secondary antenna and folding the wing antenna assemblies toward the main antenna. When in use, the wing antenna assemblies can be unfolded to receive signals from different directions.

11 Claims, 6 Drawing Sheets

COLLAPSIBLE INTERIOR ANTENNA

BACKGROUND OF THE INVENTION

1. Field of Invention

The present invention relates to an interior antenna, and more particularly to an interior antenna assembly comprising two side wings that can be unfolded for receiving electromagnetic wave signals from different directions.

2. Description of the Related Art

Television programs are transmitted using cable lines or electromagnetic wave signals. An assistance interior antenna is wildly used for enhancing the electromagnetic wave signal receiving ability to improve clarity of television programs. Normally, the assistance interior antenna is formed as rectangular like and has an unchangeable shape and volume. Furthermore, a conventional assistance interior antenna can only receive a narrow frequency band.

The present invention provides a collapsible interior antenna to obviate or mitigate the shortcomings of the conventional assistance interior antenna.

SUMMARY OF THE INVENTION

The primary objective of the present invention is to provide a collapsible interior antenna to reduce a footprint of the collapsible interior antenna during storage and receive signals from multiple directions.

The collapsible interior antenna has a main antenna, two wing antenna assemblies and a secondary antenna. The main antenna is rectangular and has two opposite connecting edges. The wing antenna assemblies are pivotally mounted respectively on the connecting edges and coupled transmittably with the main antenna. The secondary antenna is a telescopic antenna, receives signals having a different frequency band to the main antenna and is electrically mounted on the main antenna.

A person can minimize the collapsible interior antenna by retracting the secondary antenna and folding the wing antenna assemblies toward the main antenna. When in use, the wing antenna assemblies can be unfolded to receive signals from different directions.

Other objectives, advantages and novel features of the invention will become more apparent from the following detailed description when taken in conjunction with the accompanying drawings.

DETAILED DESCRIPTION OF THE INVENTION

Figure 1:
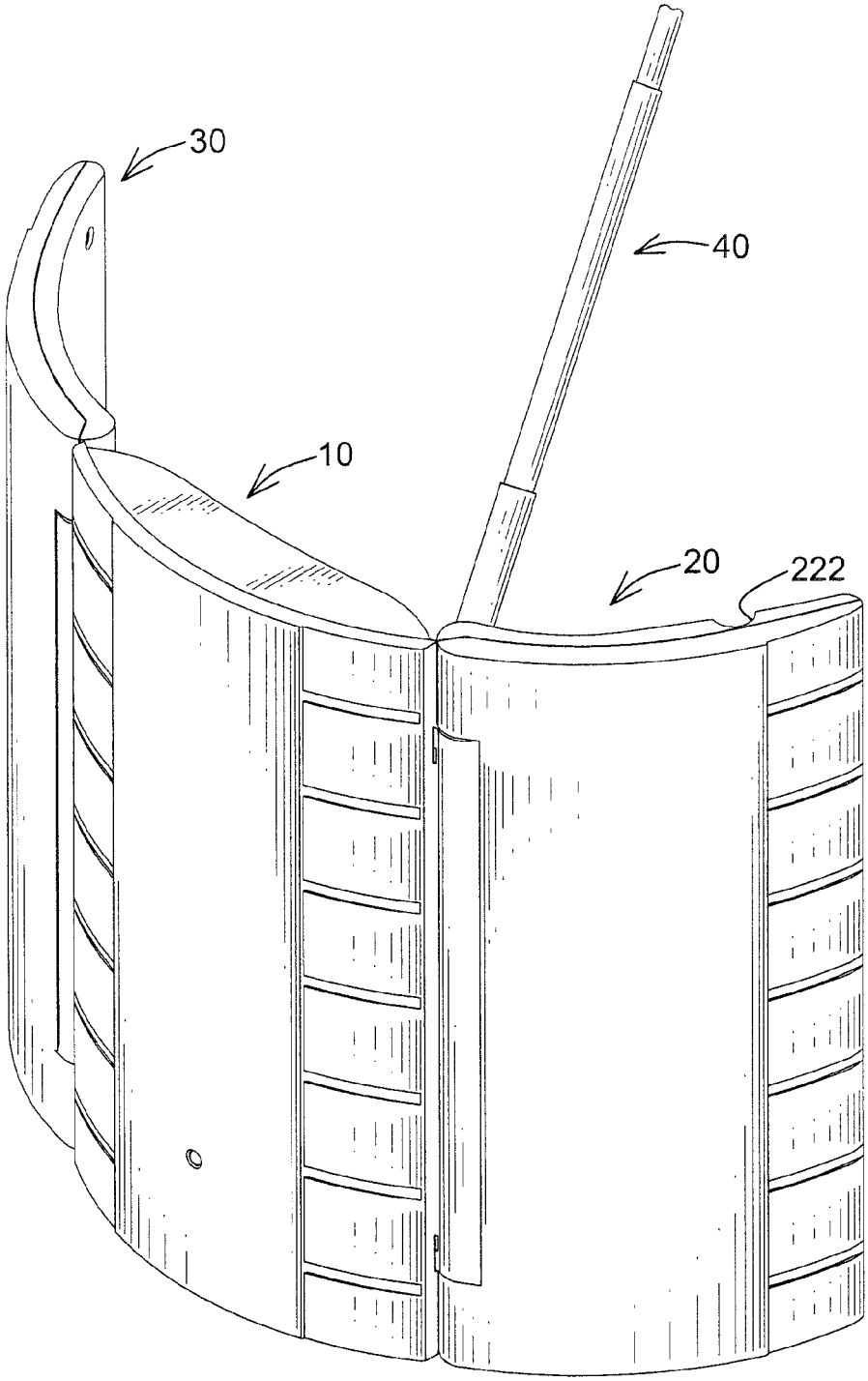
FIG. 1 is a perspective view of a collapsible interior antenna in accordance with the present invention.
Figure 2:
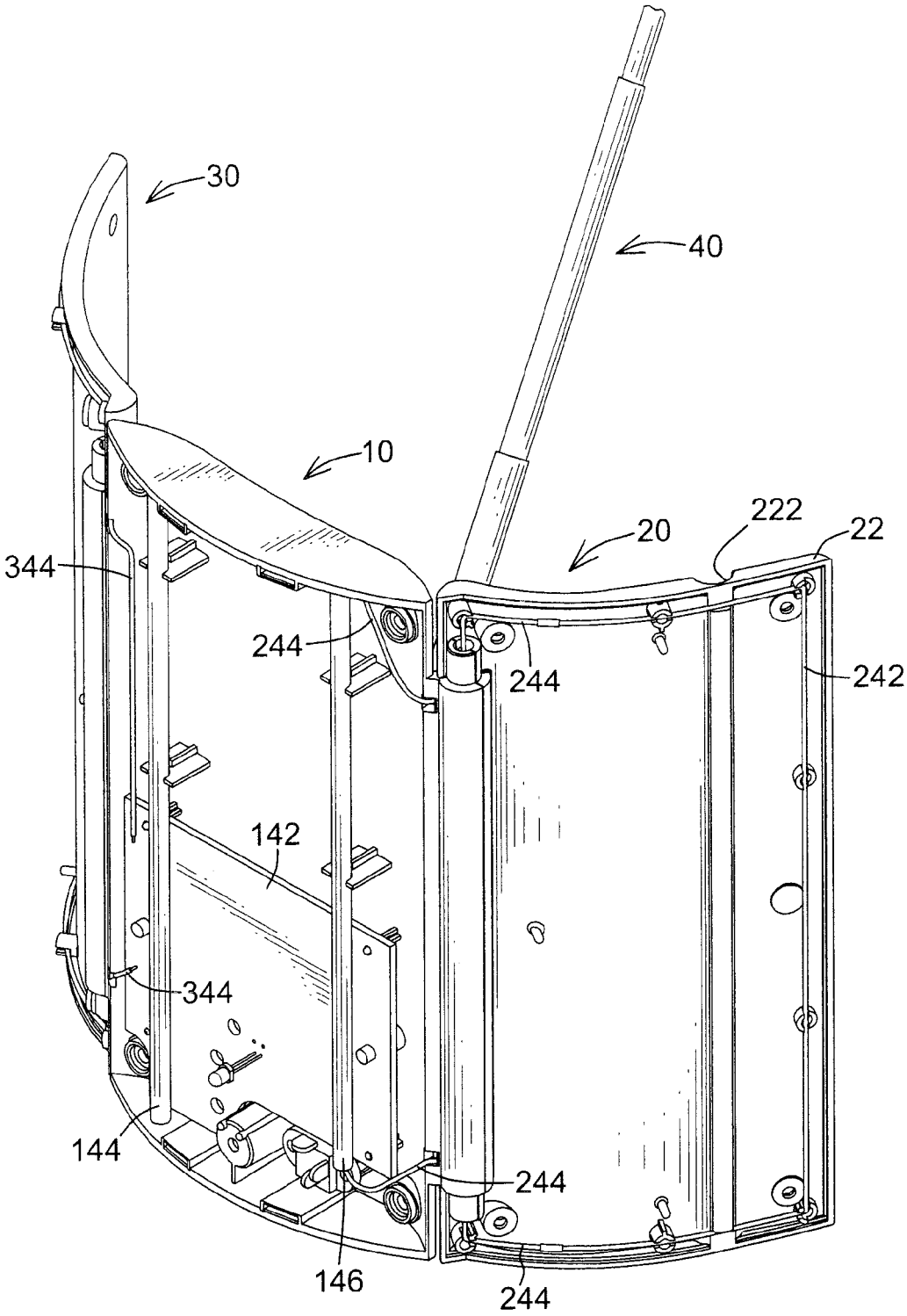
FIG. 2 is a perspective view of the collapsible interior antenna in FIG. 1, with a front cover removed.
Figure 3:
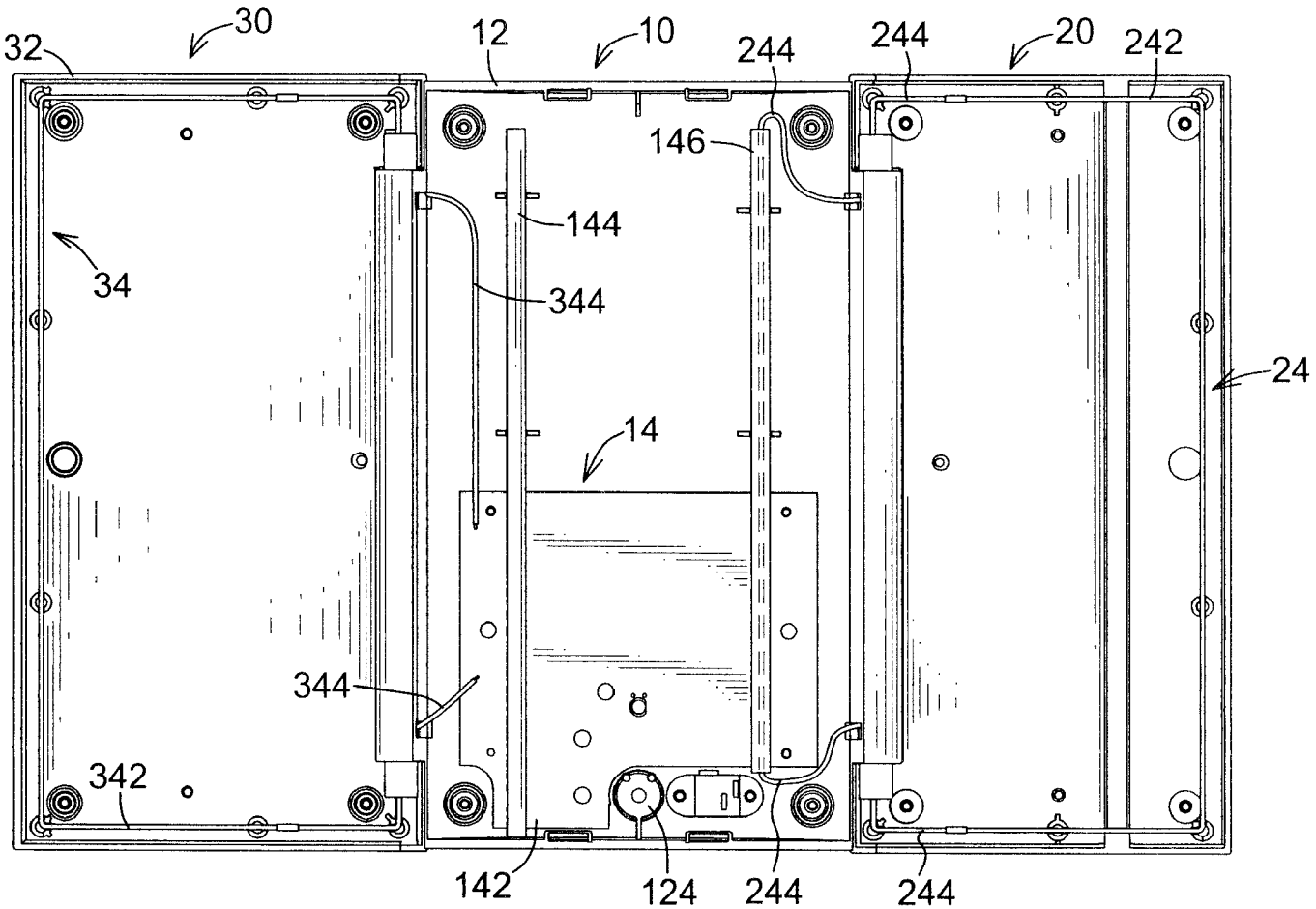
FIG. 3 is a front view of the collapsible interior antenna in FIG. 2.
Figure 4:
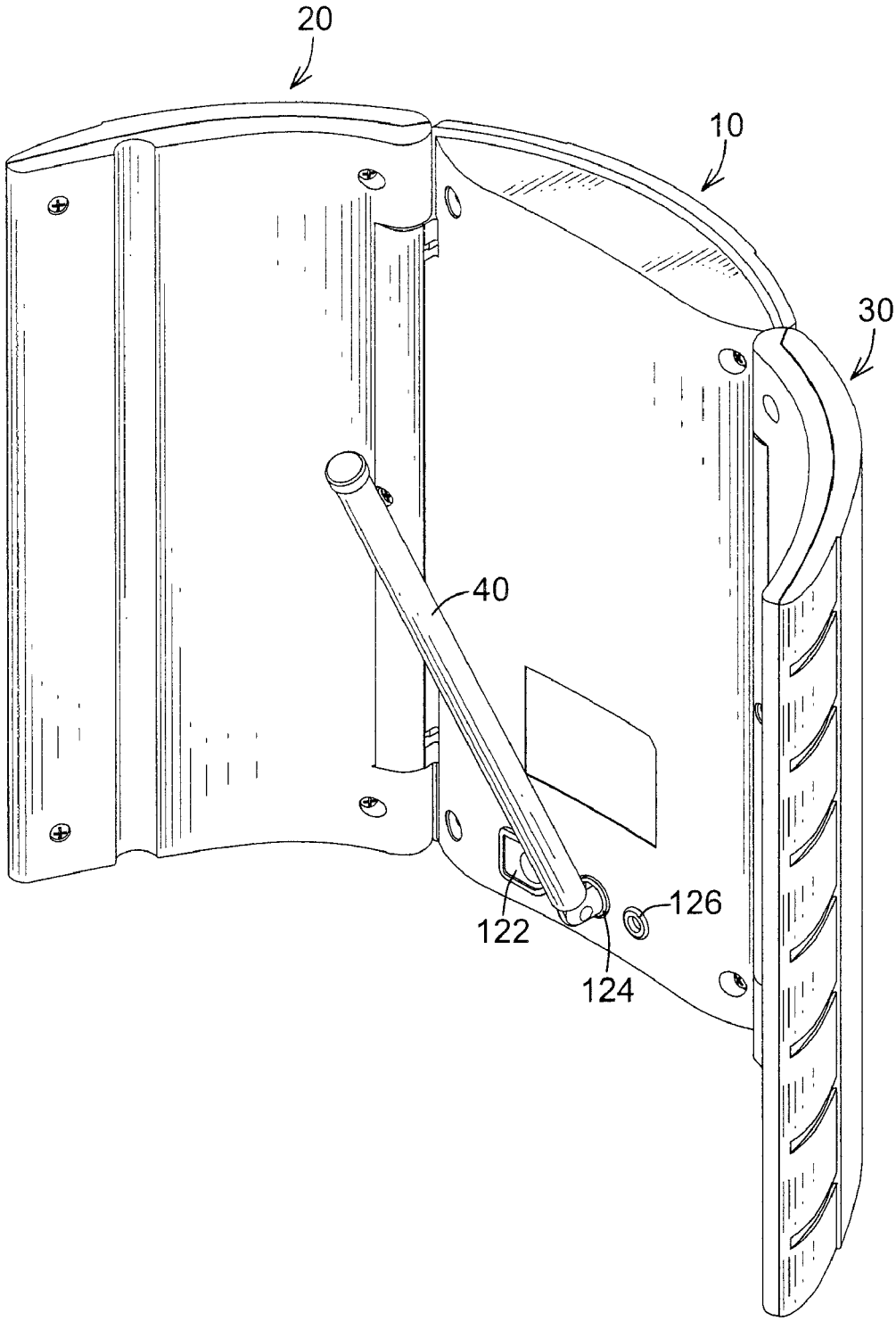
FIG. 4 is a rear perspective view of the collapsible interior antenna in FIG. 1.

With reference to FIGS. 1, 2, and 4, a collapsible interior antenna in accordance with the present invention comprises a main antenna (10), two wing antenna assemblies (20,30) and an optional secondary antenna (40).

The main antenna (10) is capable of receiving television signals transmitted under Ultra High Frequency (UHF) and has a main case (12) and a main antenna assembly (14). The main case (12) may be rectangular, a polygon box or the like, may be convex, and has an optional power hole (122), an optional antenna plug hole (124), an optional signal output hole (126), a rear surface and two connecting edges. The power hole (122), the antenna plug hole (124) and the signal output hole (126) are formed through the rear surface of the main case (12). The connecting edges are opposite edges of the main case (12).

Figure 6:
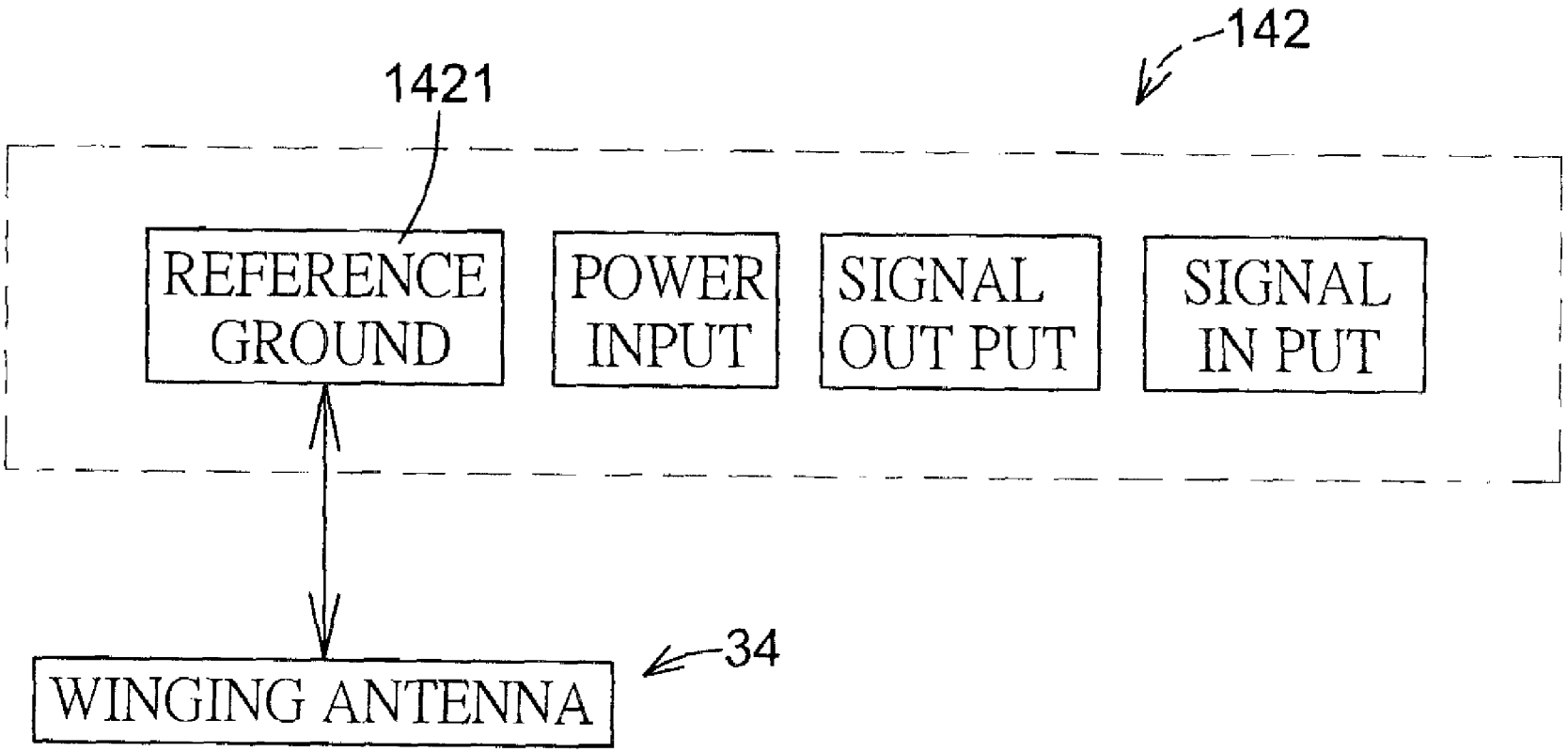
FIG. 6 is a block diagram of a circuit board of the interior antenna in FIG. 1.

With further reference to FIG. 6, the main antenna assembly (14) may be a micro-strip planer antenna, a rod-like antenna or the like, and is mounted inside the main case (12). In a preferred embodiment of the present invention, the main antenna assembly (14) has a circuit board (142), a primary antenna tube (144) and a secondary antenna tube (146). The circuit board (142) is a television signal processing circuit assembly, is mounted in the main case (12) and has a reference ground (1421), a power input, a signal output and a signal input. The power input is formed on the circuit board (142) corresponding to the power hole (122) of the main case (12) and electrically connects to an external power source. The signal output is formed on the circuit board (142) corresponding to the signal output hole (126), and is electrically connected to a signal cable line of a television and transmits television signals to the television.

The primary antenna tube (144) and the secondary antenna tube (146) are hollow straight conductive tubes, are separately mounted parallelly on and electrically connected to the circuit board (142), receive and then transmit the television programs signal to the circuit board (142).

The wing antenna assemblies (20,30) receive the television signals and are pivotally mounted respectively on the connecting edges of the main case (12) and each has a wing case (22,32) and a wing antenna (24,34). The wing cases (22,32) correspond to and are pivotally mounted respectively on the connecting edges of the main case (12) so that each wing case (22,32) can fold or unfold toward the main case (12). Each wing case (22,32) has a rear surface, and one of the wing cases (22,32) may have an optional recess (222). In the preferred embodiment of the present invention, the recess (222) is straight and is formed in the rear surface of the wing case (22).

The wing antennas (24,34) are mounted respectively inside the corresponding wing cases (22,32) and are transmittably coupled to the main antenna assembly (14) independently. In the preferred embodiment of the present invention, each wing antenna (24,34) has a conductive antenna wire (242,342) and at least one insulated coupling wire (244,344). The conductive antenna wire (242,342) is partially looped inside the wing case (22,32) and connected to the coupling wire (244, 344).

One conductive antenna wire (242) is connected to one of the coupling wires (244) that is further intermittently threaded longitudinally in and out of the secondary antenna tube (146) to form a closed loop.

The other conductive antenna wire (342) is connected to the reference ground (1421) of the circuit board (142) using two coupling wires (344).

The secondary antenna (40) receives television signals transmitted under a different frequency band from the main antenna (10) and connected electrically to the circuit board (142) of the main antenna assembly (14). In the preferred embodiment of the present invention, the secondary antenna (40) is mounted pivotally in the antenna plug hole (124), receives television signals transmitted under Very High Frequency (VHF), is a telescopic antenna corresponding to the recess (222) and connected electrically to the circuit board (142) through the antenna plug hole (124).

Figure 5:
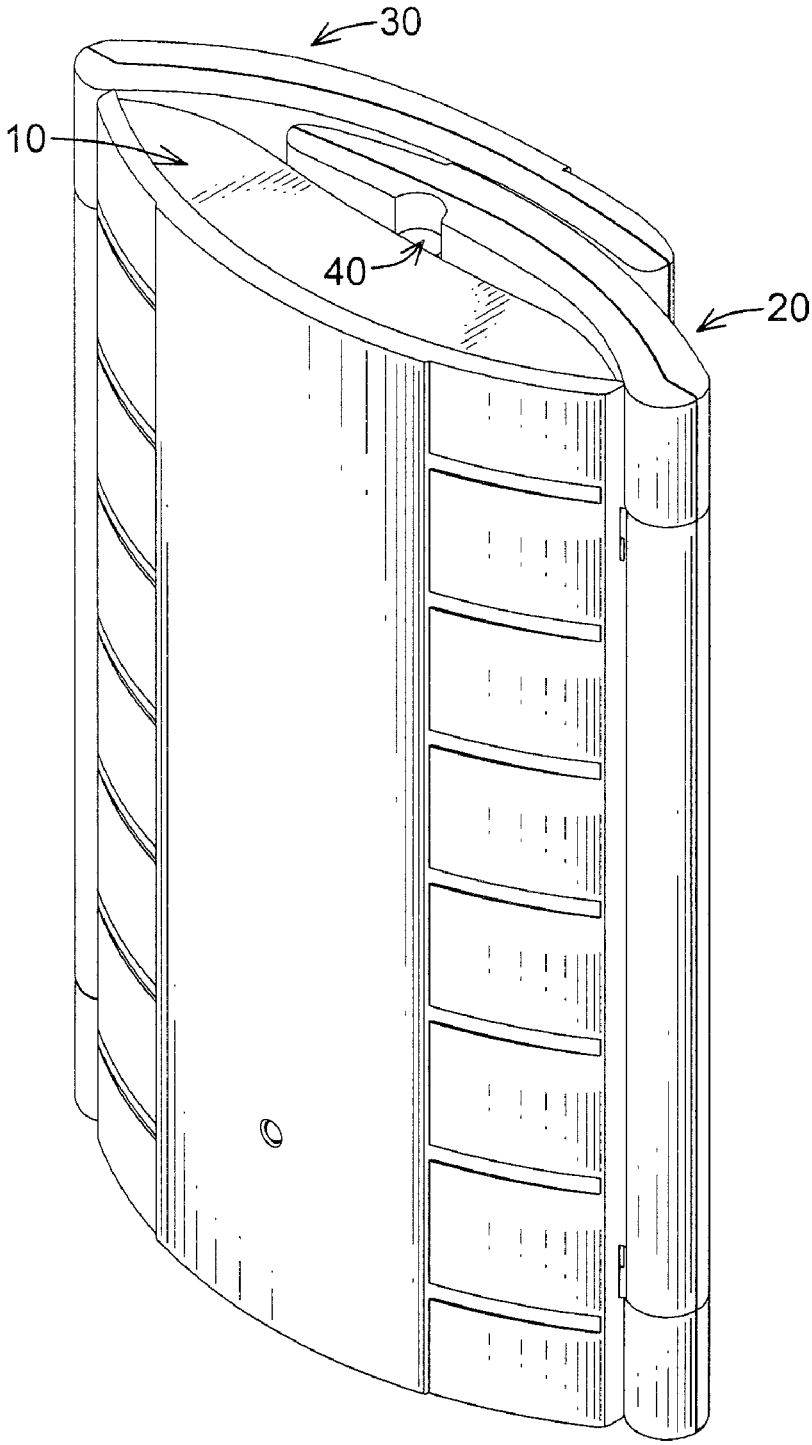
FIG. 5 is a perspective view of the collapsible interior antenna in FIG. 1, shown folded.

With further reference to FIG. 5, a footprint of the collapsible interior antenna can be minimized by retracting the secondary antenna (40) or folding the wing antenna assemblies (20)(30) toward the rear surface of the main case (12). Furthermore, because the wing antenna assemblies (20)(30) are pivotally connected to the main antenna (10), a person can vary an angle of the wing antenna assemblies (20)(30) from the main antenna (10) to achieve a best arrangement to receive television signals. Moreover, the preferred embodiment of the present invention has a large band of signal receiving capability because the secondary antenna (40) is designed for receiving television programs signal having different frequency bands to the main antenna (10).

Even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. A collapsible interior antenna comprising a main antenna being capable of receiving television signals and having a main case being rectangular and having a rear surface;

two connecting edges being opposite edges of the main case;

a power hole being formed through the rear surface of the main case;

an antenna plug hole being formed through the rear surface of the main case; and a signal output hole being formed through the rear surface of the main case; and a main antenna assembly being mounted inside the main case and having a circuit board being a television signal processing circuit assembly, being mounted in the main case and having a reference ground;

a power input being formed on the circuit board and corresponding to the power hole of the main case;

a signal output being formed on the circuit board and corresponding to the signal output hole; and a signal input;

a primary antenna tube being a hollow straight conductive tube, being mounted on and electrically connected to the circuit board; and a secondary antenna tube being a hollow straight conductive tube, being mounted on and electrically connected to the circuit board separately and parallelly to the primary antenna tube;

two wing antenna assemblies being capable of receiving television signals and being pivotally mounted respectively on the connecting edge of the main case, and each having a wing case being mounted pivotally on one of the connecting edges of the main case and having a rear surface; and a wing antenna being mounted inside the wing case and transmittably coupled to the main antenna assembly.

2. The collapsible interior antenna as claimed in claim 1, wherein each wing antenna has a conductive antenna wire being partially looped inside the wing case of the wing antenna; and at least one insulated coupling wire, where one of the conductive antenna wires is connected to one of the coupling wires, that is further intermittently threaded longitudinally in and out of the secondary antenna tube to form a closed loop; and the other conductive antenna wire is connected to the reference ground of the circuit board with two coupling wires.

3. The collapsible interior antenna as claimed in claim 2, wherein the collapsible interior antenna has a secondary antenna capable of receiving television signals transmitted under a different frequency band from the main antenna and being connected electrically to the main antenna assembly.

4. The collapsible interior antenna as claimed in claim 3, wherein the secondary antenna is a telescopic antenna, is mounted rotatably in the antenna plug hole and is connected electrically to the circuit board; and one of the wing cases has a recess being straight, corresponding to the secondary antenna and being formed in the rear surface of the wing case.

5. The collapsible interior antenna as claimed in claim 4, wherein the main antenna and the secondary antenna receive television programs signals under UHF and VHF respectively.

6. The collapsible interior antenna as claimed in claim 3, wherein the main antenna and the secondary antenna receive television programs signals under UHF and VHF respectively.

7. The collapsible interior antenna as claimed in claim 1, wherein the collapsible interior antenna has a secondary antenna capable of receiving television signals transmitted under a different frequency band from the main antenna and being connected electrically to the main antenna assembly.

8. The collapsible interior antenna as claimed in claim 7, wherein the secondary antenna is a telescopic antenna, is mounted rotatably in the antenna plug hole and is connected electrically to the circuit board; and one of the wing cases has a recess being straight, corresponding to the secondary antenna and being formed in the rear surface of the wing case.

9. The collapsible interior antenna as claimed in claim 8, wherein the main antenna and the secondary antenna receive television programs signals under UHF and VHF respectively.

10. The collapsible interior antenna as claimed in claim 7, wherein the main antenna and the secondary antenna receive television programs signals under UHF and VHF respectively.

11. An collapsible interior antenna, comprising:

(A) a main antenna adapted to receive television signals, and having:

(1) a main case, having:

(a) a rear surface; and (b) two connecting edges which are opposite edges of the main case; and (2) a main antenna assembly mounted inside the main case, and having a circuit board and an antenna plug hole;

(B) two wing antenna assemblies adapted to receive television signals and being respectively pivotally mounted on the connecting edges of the main case, each wing antenna having:

(1) a wing case pivotally mounted on one of the connecting edges of the main case and having a rear surface; and (2) a wing antenna mounted inside the wing case and being transmittably coupled to the main antenna assembly; and (C) a secondary antenna, which is a telescopic antenna, and being adapted to receive television signals transmitted under a different frequency band from the main antenna, the secondary antenna being electrically connected to the circuit board of the main antenna assembly, and being rotatably mounted in the antenna plug hole;

wherein one of the wing cases has a straight recess formed in a rear surface thereof and that corresponds to the secondary antenna.

* * * * *